US008070418B2

(12) United States Patent
Zipp

(10) Patent No.: US 8,070,418 B2
(45) Date of Patent: Dec. 6, 2011

(54) VACUUM PUMP

(75) Inventor: Andeas Zipp, Asslar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 658 days.

(21) Appl. No.: 12/284,197

(22) Filed: Sep. 19, 2008

(65) Prior Publication Data

US 2009/0092484 A1 Apr. 9, 2009

(30) Foreign Application Priority Data

Sep. 20, 2007 (DE) ..... 10 2007 044 945

(51) Int. Cl.
*F01D 1/36* (2006.01)

(52) U.S. Cl. ..... 415/90

(58) Field of Classification Search ..... 415/90, 415/214.1, 143, 213.1
See application file for complete search history.

(56) References Cited

U.S. PATENT DOCUMENTS 4,057,369 A * 11/1977 Isenberg et al. ..... 417/365
4,116,592 A * 9/1978 Cherny et al. ..... 417/423.4
5,893,702 A * 4/1999 Conrad et al. ..... 415/71
6,705,830 B2 * 3/2004 Yamashita et al. ..... 415/9
2008/0056886 A1 * 3/2008 Hablanian ..... 415/90

* cited by examiner

*Primary Examiner* — Gary F. Paumen
(74) *Attorney, Agent, or Firm* — Abelman, Frayne & Schwab

(57) ABSTRACT

A vacuum pump includes a gas inlet, a quick-rotatable rotor connectable with a flange of a multi-chamber vacuum installation which flange has a plurality of suction openings separated by separation walls, and a gas path separating structure which is located in the gas inlet of the pump, dividing the gas inlet in suction regions, and which seals, together with the separation walls, chambers of the multi-chamber vacuum installation.

7 Claims, 6 Drawing Sheets

VACUUM PUMP

BACKGROUND OF THE INVENTION

1. Field of the Invention

The present invention relates to a vacuum pump including a gas inlet and a quick-rotatable rotor connectable with a flange of a multi-chamber vacuum installation, with the flange having a plurality of suction openings separated by a separation wall(s).

2. Description of the Prior Art

In a number of applications, several vacuum chambers arranged in a row and are connected with each other by bores having a small transmissive capacity. The gas pressure in the vacuum chambers is reduced from one end of the row of the vacuum chambers to another end. The bores are so formed that a particle beam can pass therethrough and, thus, through the row of vacuum chambers. The vacuum chambers with a low pressure often contain an analyzer, e.g., a mass spectrometer.

The state-of-the art discloses different ways of producing vacuum in vacuum chambers and maintain it there.

A first conventional way of producing and maintaining vacuum in a plurality of vacuum chambers consists in providing each vacuum chamber with its own flange. A vacuum pump, which is suitable for the pressure region, is then secured to the flange. This way is no acceptable because of high costs of a plurality of pumps. In addition, there is a need in compact apparatuses. This cannot be realized with a plurality of vacuum pumps.

A second conventional way is disclosed in German Publication DE-OS 43 31 589. This publication discloses a turbomolecular pump having a plurality of suction connections connectable with a respective plurality of vacuum chambers. The suction connections guide the gas to different, axially spaced parts of the rotor. Along the rotor axis there are arranged so-called rotor-stator packages that compress the gas. A high vacuum-side rotor-stator package produces a pressure ratio between its inlet and outlet. The inlet is connected with a first vacuum chamber. The outlet is connected with an inlet of the following rotor-stator package. In addition, the region between the outlet of the first rotor stator package and the inlet of the following rotor-stator package is connected with a second vacuum chamber. Because of the pressure ratio, which is produced by the first rotor-stator package and a poor transmissive capacity between the two, first and second, vacuum chambers the pressures in the two chambers are different. With a corresponding number of rotor-stator packages, several vacuum chambers can be evacuated at different pressures, with a rotor-stator package being associated with each suction connection. However, because the rotors operate with a rotational speed in the range of about ten thousand revolutions per minute, it is difficult to handle very long, in comparison with their diameter, rotors.

Accordingly, an object of the present invention is to provide a vacuum pump for a multi-chamber vacuum installation and having a simplified construction while capable, at the same time, to maintain a pressure difference between at least two chambers.

SUMMARY OF THE INVENTION

This and other objects of the present invention, which will become apparent hereinafter, are achieved by providing a gas path separating structure which is located in the gas inlet, dividing same in suction regions, and which seals, together with the separation wall(s), chambers of the multi-chamber vacuum installation. The gas path separating structure permits to divide the suction capacity of the vacuum pump available at the gas inlet between two or more vacuum chambers. The gas path separating structure, because of its arrangement in the gas inlet, provides for a most possible suppression of interaction between the chambers. This is achieved by suppression of flow between the suction regions with the gas path separating structure. Together with the sealing action, it becomes possible to achieve different pressures. The term "sealing" means, in this connection, that the amount of gas passing between a separation wall and the gas path separating structure is so small that a pressure difference between the chambers can be maintained.

According to a further development of the present invention at least a portion of a bearing, which rotatably supports the rotor, is held in the gas path separating structure. This part includes, e.g., a ring of permanent magnets or an outer ring of a ball bearing. Thereby, the bearing is provided on a high vacuum-side of the shaft end, which has rotary dynamic advantages. These advantages can be used without additional components, costs and height space.

According to a still further development of the present invention, vanes are located in one of the suction region. This reduces backflow of gas from the vacuum pump into the chamber. Thereby, a greater pressure difference between the chambers can be obtained.

The arrangement of vanes in the gas inlet in the gas flow direction in front of the first rotor disc can be further improved by providing an entire stator disc. This is very unusual and has not been undertaken before. This is because the suction capacity of the vacuum pump is diminished by a reduced transmissive capacity of the stator disc. However, the inventor found out that the reduced transmissive capacity of the stator disc leads to an improved pressure ratio between the chambers.

According to a yet another development of the present invention, the pressure ratio is improved by providing sealing means on the flange side of the gas path separating structure. Due to the flange-side arrangement of the sealing means, the sealing means is located between the gas path separating structure and the chamber-side separation wall, sealing the chambers against each other.

The sealing is further improved with sealing means that encloses the entire suction region. Thereby, the suction regions are reliably sealed against each other.

A simplified embodiment of the sealing means includes a groove and a sealing ring located in the groove. The sealing ring reduces transmission of vibrations between the separation wall and the gas path separating structure.

The sealing of the suction regions against each other can further be improved by forming the gas path separating structure integrally with the vacuum pump housing. This also increases the mechanical stability.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Below, the gas inlet indicates the space between a flange opening and a first, in the gas flow direction, rotatable pump-active pump component.

In the following embodiments, turbomolecular pumps, shortly turbopumps, are used. However, the present invention is applicable to pumps based on a different molecular principle.

The first embodiment of the invention will be explained with reference to FIGS. 1 and 2.

Figure 1:
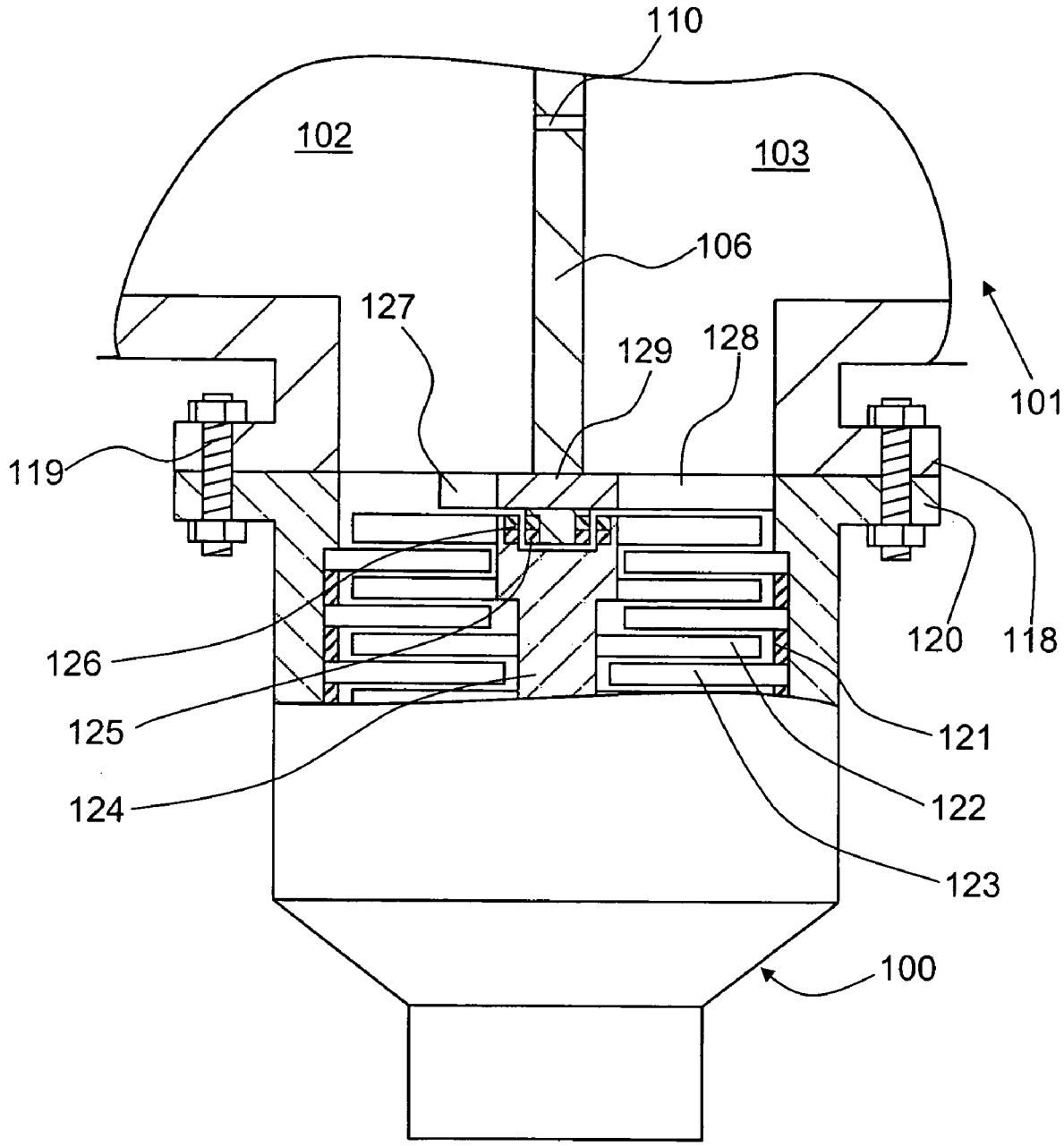
FIG. 1 a schematic cross-sectional view of a multi-chamber vacuum installation and an inventive vacuum pump according to the first embodiment.

FIG. 1 shows a multi-chamber vacuum installation 101 having a first chamber 102 and a second chamber 103 which are separated by a separation wall 106. Through a bore 110, which is provided in the separation wall 106, a particle beam can pass from the first chamber 102 into the second chamber 103. The first and second chambers 102 and 103, respectively, are evacuated at different pressures. The multi-chamber installation 101 has a flange 118 to which a vacuum pump 100 is releasably secured. The separation wall 106 extends up to the flange 118, dividing the flange surface.

The vacuum pump 100 has a flange 120 that abuts the flange 118 of the vacuum installation 101. The flange 118 of the vacuum installation 101 and the flange 120 of the vacuum pump 100 are releasably connected with each other, e.g., with screws 119. In the embodiment shown in FIG. 1, the vacuum pump 100 is formed as a turbomolecular pump. The pump 100 has a rotor 124 with vanes 122 which extend radially in a plurality of planes along the circumference of the rotor 124. Between the vane planes, stator vanes 126 are provided. The planes of the stator vanes 126 are spaced from each other by spacer rings 121. The flange-side end of the rotor 124 is supported by a passive magnetic bearing. The bearing includes a plurality of permanent magnets secured on the bearing stator 125 and the bearing rotor 126. A central disc 129 supports the bearing stator. The disc 129 is secured in the gas inlet with webs 127 and 128. The webs 127 and 128 and the central disc 129 form together a gas path separating structure that divides, in this case, the gas inlet into two suction regions each of which is connected with a respective one of the first and second chambers 102 and 103.

Figure 2:
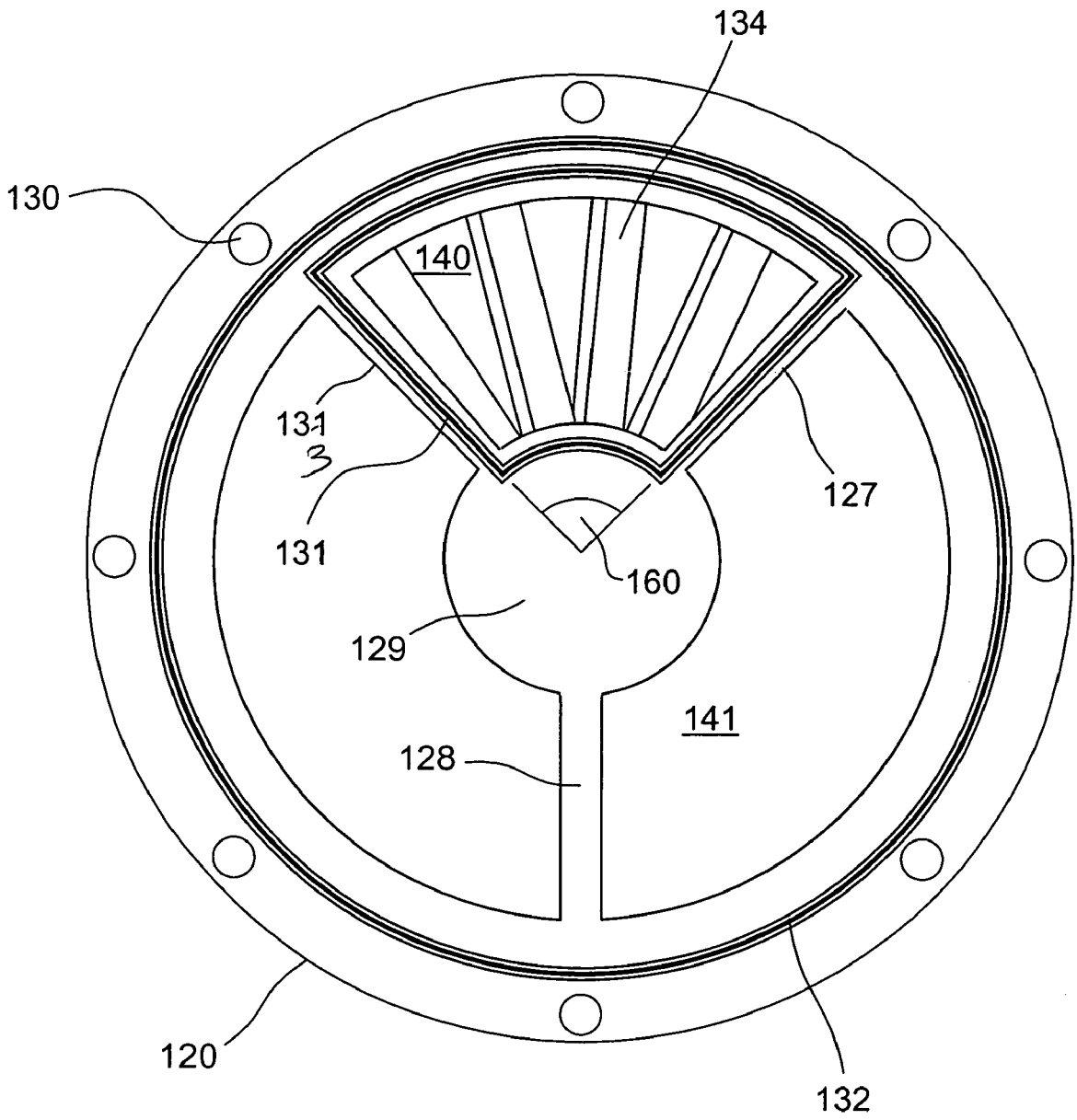
FIG. 2 a plan view of the gas inlet of the inventive vacuum pump according to the first embodiment.

FIG. 2 shows a plan view of the flange 120 of the vacuum pump 100. For the sake of clarity, within the flange opening, only components in the gas inlet of the vacuum pump are shown. Separate visible rotor and stator components are not shown.

Along the flange circumference, a plurality of bores 130 are distributed. Through the bores 30, screws 119 for attaching the vacuum pump 100 are extendable. An outer seal 132 is concentrically arranged with the ring of bores 130. The seal 132 is formed as a sealing ring placed in a groove. The central disc 129 is secured in the gas inlet with three webs 127, 128 and 133. The central disc 129 forms, together with the webs 133 and 127, a gas path separating structure. The webs 127 and 133 touchingly contact, along their entire length, the separation wall 106 of the multi-chamber vacuum installation 101. The webs 127, 133 divide the gas inlet and form in the embodiment shown in the drawings, two suction regions 140 and 141. For a better sealing of these two suction regions, a seal 131, which extends around the suction region 140, is provided. The seal 131 is formed as a sealing ring placed in a groove. In the suction region 140, there are provided vanes 134 which prevent the return flow of gas from the vacuum pump 100. The inner seal ring 131 reduces the transmission vibrations from the separation wall 106 to the gas path separating structure and vice versa.

The angle 160 between the webs 127 and 133 determines the surface ratio of the suction regions 140 and 141. This ratio influences the suction capacity the two suction regions 140 and 141 achieve.

Figure 3:
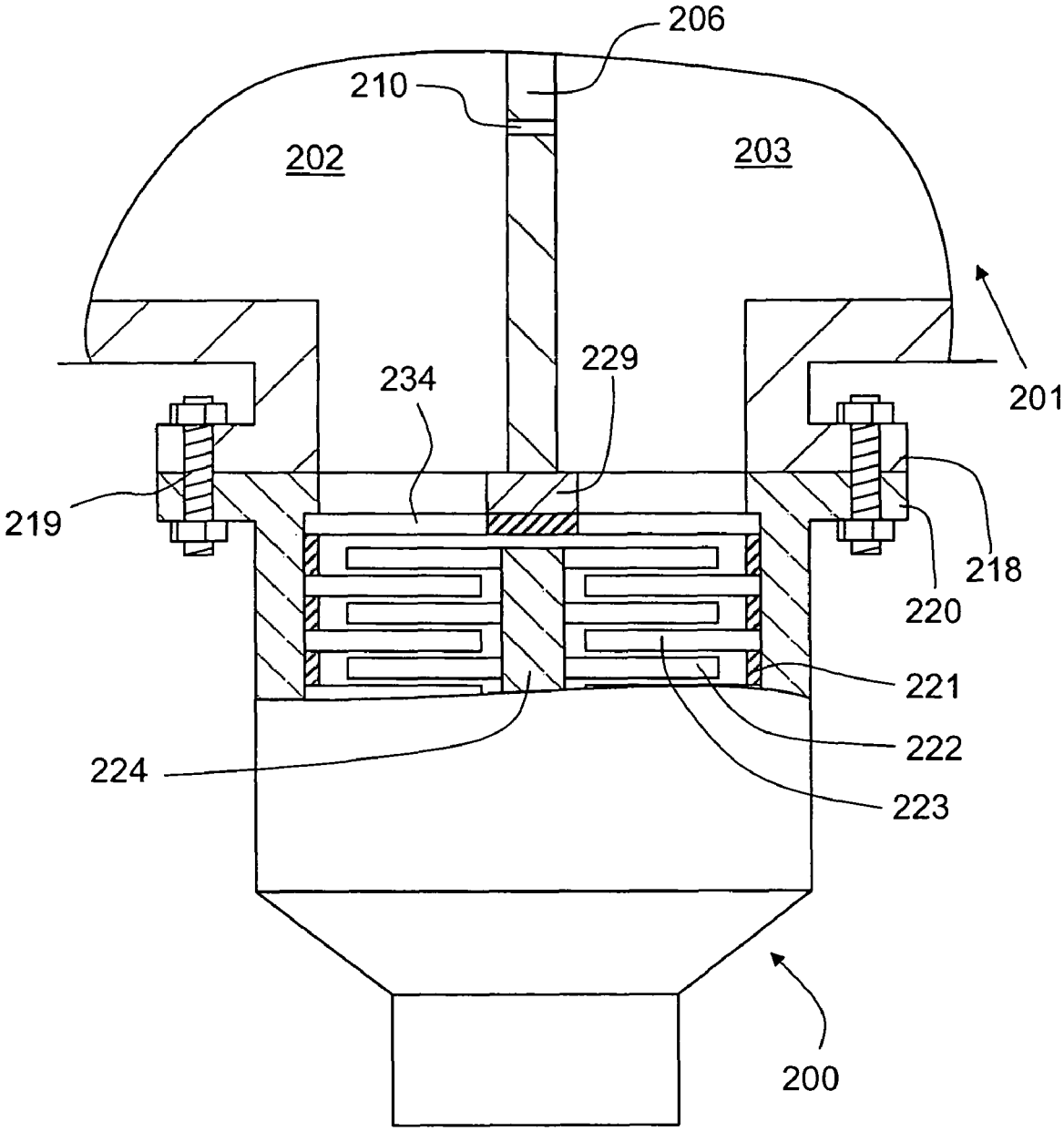
FIG. 3 a schematic cross-sectional view of a multi-chamber vacuum installation and an inventive vacuum pump according to the second embodiment.

A second embodiment of the invention will be explained with reference to FIGS. 3-4. FIG. 3 shows a partial cross-section of the multi-chamber installation 201 with which a vacuum pump 200 is releasably connected.

A chamber side flange 218 and the pump flange 220 provide for a releasable connection of the multi-chamber vacuum installation 201 and the vacuum pump 200. The flanges 218 and 220 are secured to each other with screws 219.

In the multi-chamber vacuum installation 202, there are provided two chambers, a first chamber 201 and a second chamber 203 separated from each other by a separation wall 206. A bore 210, which is formed in the separation wall 206, enables passing of a particle beam from the first chamber 202 into the second chamber 203 and vice versa. The separation wall 206 extends up to the chamber side flange 218.

For producing a high vacuum, the vacuum pump 220 includes a rapidly rotatable rotor 224 with vanes 222 which extend radially in a plurality of plane along the circumference of the rotor 224. Between the vane planes, stator vanes 223 are provided. The planes of the stator vanes 223 are spaced from each other by spacer rings 221. The rotor 224 can be floatingly supported in a per se known manner or be formed as a bell-shaped rotor. In this case, no bearing is needed at the vacuum side end of the rotor.

In the embodiment shown in FIG. 3, the gas path separating structure includes a stator disc 234 provided with stator vanes. Between the chambers 202 and 203 and the first vane plane of the rotor 224, there is provided, contrary to the general teaching of the state of art, a stationary pump-active element. In addition, the gas path separating structure includes a central disc 229 and two webs, not shown in FIG. 3. The central disc 229 and the webs touchingly contact the separation wall 206.

Figure 4:
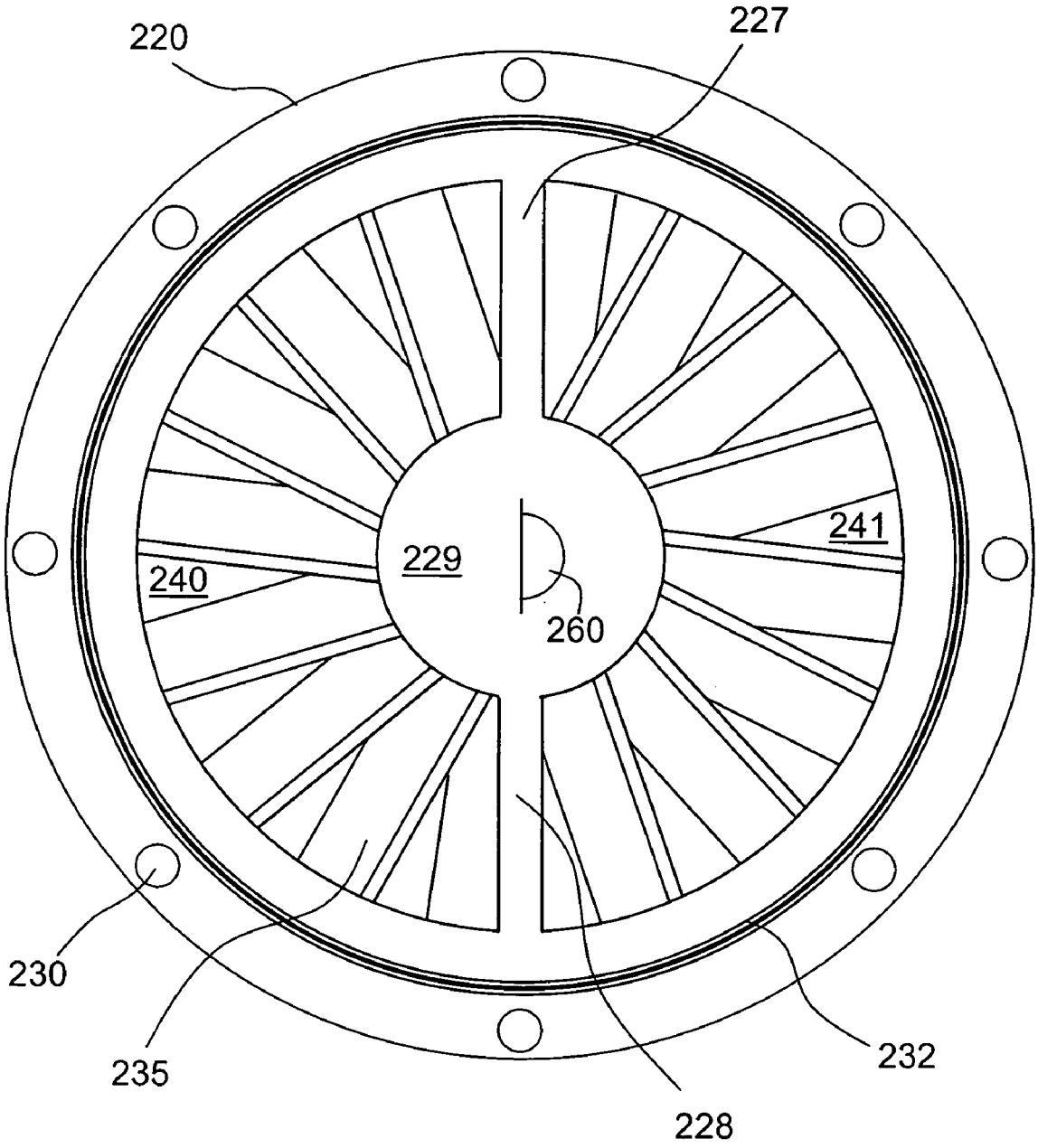
FIG. 4 a plan view of the gas inlet of the inventive vacuum pump according to the second embodiment.

FIG. 4 shows a plan view of the flange 220 of the vacuum pump 200. The central disc 229 is held in a predetermined position by first and second webs 227 and 228. The central disc 229 and both webs 227, 228 are in a touching contact with the separation wall 206, whereby the separation of the first chamber 202 from the second chamber 203 is effected. The central disc 229 and the webs 227, 228 divide the gas inlet in two suction regions 240 and 241 connected with respective chambers 202 and 203. In the gas flow direction, behind the central disc 229 and the webs 227 and 228, there is provided a stator disc having vanes 235. Both suction regions 240, 241 are surrounded by a seal 232. The seal 232 is formed as a sealing disc located in a groove. The flange 220 has a plurality of bores distributed over the flange circumference and through which screws, bolts or the like are extendable for connecting the pump 200 with the multi-chamber vacuum installation 201.

In both the first and second embodiments, the respective separation walls 106 and 206 of the respective multi-chamber installations 101 and 201 extend up to respective flanges 118, 218. If this cannot be done, the gas path separating structure can so be formed that it projects into the flange 118 or 218 so far that they are brought into contact with the separation walls 106, 206, respectively.

The angle 260 between the webs 227 and 228, which in the embodiment shown in FIG. 2 amounts to 180°, determines the surface ratio of the suction regions 240 and 241. This ratio influences the suction capacity the two suction regions 140 and 141 achieve.

The third embodiment will be discussed with reference to FIG. 5.

Figure 5:
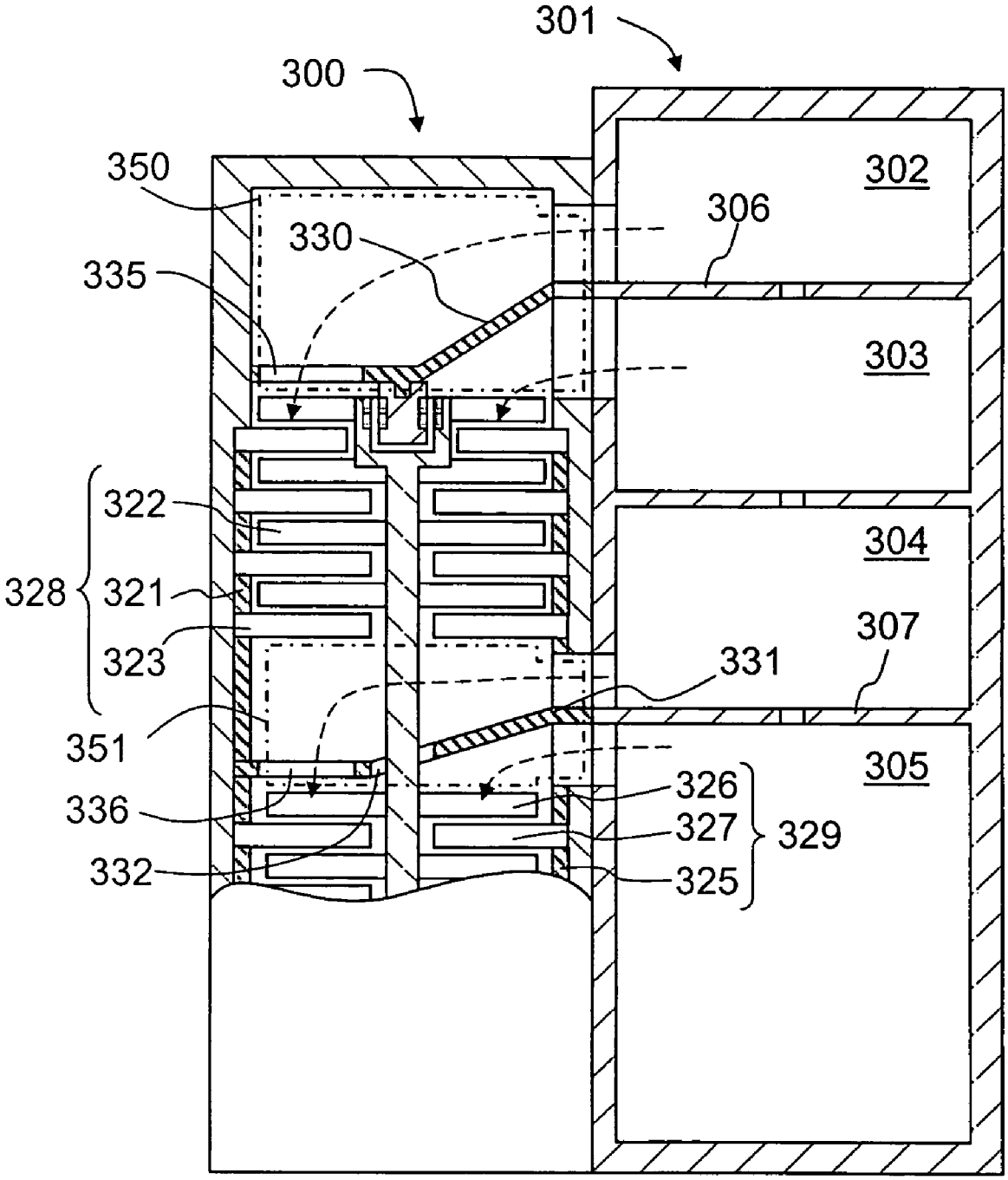
FIG. 5 a schematic cross-sectional view of a multi-chamber vacuum installation and an inventive vacuum pump according to the third embodiment.

In the embodiment shown in FIG. 5, the multi-chamber vacuum installation 301 has four chambers 302, 303, 304 and 305, with the gas pressure increasing from the first chamber 302 to the fourth chamber 305. The chambers 302 through 305 are separated from each other by respective separation walls and are connected with each other by bores formed in the separation walls. The bores are, e.g., so arranged and dimensioned that a particle beam can penetrate through all of the chambers 302 through 305. The first separation wall 306 separates the first chamber 302 and the second chamber 303, and the second separation wall 307 separates the third chamber 304 and the fourth chamber 305. The embodiment shown in FIG. 5 illustrates the use of the present invention with such multi-chamber vacuum installations, and how increased costs and constructional volumes are dispensed with. The arrows, which are shown with dash lines, show the gas flow.

The vacuum pump 300, which is shown in the embodiment of FIG. 5, has two rotor-stator packages. The spacer rings 321, rotor vanes 322, and stator vanes 323 form a high vacuum-side rotor-stator package 328. An intermediate vacuum-side rotor-stator package 329 is formed by spacer rings 325, rotor vanes 326, and stator vanes 327. As is known in the state of the art, the vanes of both stator-rotor packages 328 and 329 are secured on support rings or are formed integrally therewith as on the stator side so on the rotor side. In front of the high vacuum-side rotor-stator package 328, there is provided a first gas inlet 350, and in front of the intermediate rotor-stator package 329, there is provided a second gas inlet 351.

A first gas path separating structure 330 is arranged in the first gas inlet 350 and divides it into two suction regions. The gas path separating structure 330 contacts the first separation wall 306. Each suction region is connected only with one of the first and second chambers 302 and 303, so that the pumping action of the first rotor-stator package 328 provides for evacuation of both chambers 302 and 303. A gas passage 335 in the first gas path separating structure 330 connects a portion of the first rotor disc of the first rotor-stator package 328 with the first chamber 302. The size of the passage 335 determines the transmissive capacity and, thus, influences an effective suction capacity with which the chamber is evacuated.

A second gas path separating structure 331 is arranged in the second gas inlet 351. The second gas path separating structure 331 has a passage that is formed in the shaft. The free opening of the passage is so large that no obstacle occurs even at the maximal radial deviation of the rotor. The second gas path separating structure 331 contacts the second separation wall 307. A gas passage 336 connects a portion of the first rotor disc of the second rotor-stator package with the third chamber 304. The size of the passage 336 determines the guide value and, thus, influences an effective suction capacity with which the chamber is evacuated.

The embodiment shown in FIG. 5 illustrates how the present invention provides for evacuation of a multi-chamber vacuum installation with four chambers by a vacuum pump with two rotor-stator packages. As illustrated, fewer components, in particular, fewer rotor-stator packages, are necessary in comparison with the state-of-the art. The use of fewer rotor-stator packages permits to shorten the shaft in comparison with the state-of-the art, which facilitates a mechanical layout.

FIGS. 6 through 9 illustrate the design of the separation wall and the gas path separating structure, which permits to seal the chambers.

Figure 6:
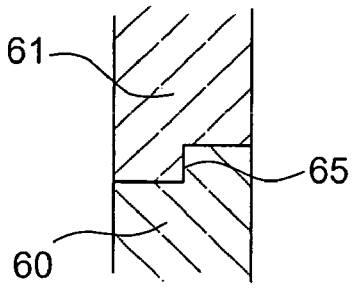
FIG. 6 a cross-sectional view of a transition region from a separation wall to a gas path separating structure according to a first embodiment of the transition region.

In FIG. 6, the gas path separating structure 60 and the separation wall 61 are in touching (butt) contact with each other. As the materials, which are used for forming the gas path separating structure and the separation wall, are, as a rule, metals and metal alloys, a metallic touching contact takes place. The amount of gas that can penetrate from one side of the arrangement to the other side is small. In addition, this amount can be reduced by one or several steps 65 which produce a labyrinth-like course of the contact area.

Figure 7:
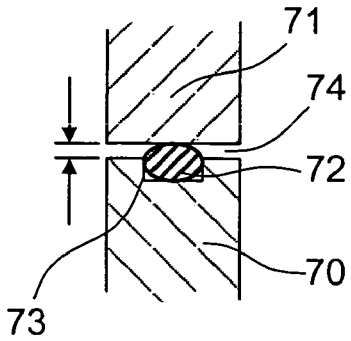
FIG. 7 a cross-sectional view of a transition region from a separation wall to a gas path separating structure according to a second embodiment of the transition region.

In FIG. 7, a seal 72 is provided between the gas path separating structure 70 and the separation wall 71. The seal 72 is located in a groove 73. The groove 73 can be formed in the gas path separating structure, in the separation wall, or in both. In this embodiment, no contact between the separation wall 71 and the gas path separating structure 70 takes place. Instead, a clearance 74 between the separation wall 71 and the gas path separating structure is formed.

The sealing is insured by the seal 73 which is formed as an elastomeric ring. The elastomeric ring advantageously dampens the vibration, whereby the transmission of vibrations between the gas path separating structure and the separation wall is reduced. The vibrations are generated in the vacuum pump, e.g., by rapid rotation of the rotor.

Figure 8:
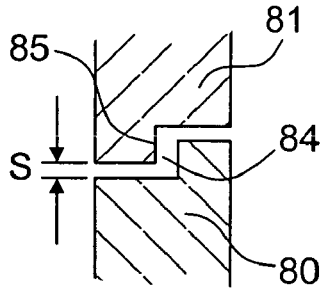
FIG. 8 a cross-sectional view of a transition region from a separation wall to a gas path separating structure according to a third embodiment of the transition region.

FIG. 8 shows a structure similar to that of FIG. 6 but without touching contact between the separation wall 81 and the gas path separating structure 80. The gas separating structure 80 is spaced from the separation wall 81 by a small distance, e.g., of a tenth of a mm. Thereby, a sealing clearance 84 with a clearance width S is formed. The clearance width S is so selected that in the considered pressure range, the gas flow through the clearance is so small that the pressure difference between the chambers can be maintained. The gas flow can be reduced with a step 85. Generally, more than one step can be formed. The sealing in this embodiment means that the gas flow through the structure, which is formed by the gas path separating wall 81, while deviating from zero, is still tolerably small. The structure shown in FIG. 8 is advantageous when a very small vibration transmission is required.

Figure 9:
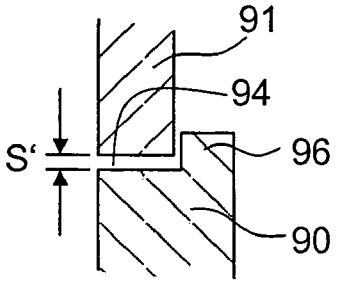
FIG. 9 a cross-sectional view of a transition region from a separation wall to a gas path separating structure according to a fourth embodiment of the transition region.

The sealing, which is illustrated in FIG. 9, is similar to that of FIG. 8. Between the gas path separating structure 90 and the separation wall 91, a clearance 94 with a clearance width S' is provided. The clearance width S' is so selected that the gas flow through the clearance is so small that the pressure difference between the chambers can be maintained. Advantageously, in this embodiment, only the end profile of the gas path separating structure 90 is modified by providing a rim 96 on one side of the separation wall 91, with the rim 96 surrounding the separation wall 91. Such a structure can be used when the vacuum pump should be mounted on an already existing multi-chamber vacuum installation, and modification of a separation wall is not possible. Such rim can also be used in the embodiments shown in FIGS. 6 and 8.

Figure 10:
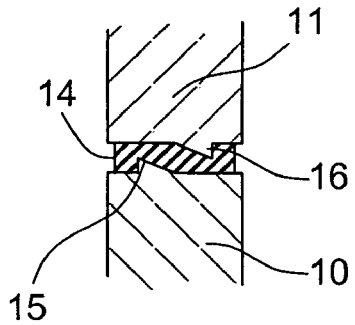
FIG. 10 a cross-sectional view of a transition region from a separation wall to a gas path separating structure according to a fifth embodiment of the transition region.

Finally, FIG. 10 shows an embodiment of the transition region from a gas path separating structure 10 to a separation wall 11, which is used when a high tightness is required. In this embodiment, a ring 14 of a soft material, e.g., copper is provided between the gas path separating structure 10 and the separation wall 11.

On the gas path separating structure 90, a cutter 15 is provided and which is pressed in the ring 14 upon connection of the vacuum pump with the multi-chamber vacuum installation. The separation wall 11 likewise has a cutter 16 which is also pressed into the ring 14. This permits to noticeably reduce gas flow between the suction regions. This flow is so small that this arrangement can be used in an ultra-high vacuum region.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A vacuum pump, comprising a gas inlet; a quick-rotatable rotor connectable with a flange of a multi-chamber vacuum installation, the flange having a plurality of suction openings separated by separation wall means; and a gas path separating structure located in the gas inlet, dividing same in suction regions, and sealing, together with the separation wall means, chambers of the multi-chamber vacuum installation, wherein at least a portion of a bearing, which rotatably supports the rotor, is held in the gas path separating structure.

2. A vacuum pump according to claim 1, wherein vanes are located in one of the suction regions.

3. A vacuum pump according to claim 1, wherein the gas path separating structure comprises a stator disc provided with vanes.

4. A vacuum pump according to claim 1, wherein the gas path separating structure comprises sealing means provided on a flange side thereof.

5. A vacuum pump according to claim 4, wherein the sealing means encloses one of the suction regions.

6. A vacuum pump according to claim 4, wherein the sealing means comprises a groove and sealing ring arranged in the groove.

7. A vacuum pump according to claim 1, wherein the gas path separating structure is formed integrally with a vacuum pump housing.

* * * * *